US005342102A

United States Patent [19]

Takimoto

[11] Patent Number: 5,342,102

[45] Date of Patent: Aug. 30, 1994

[54] LATCH ASSEMBLY FOR SLIDING DOOR

[75] Inventor: Kazuhide Takimoto, Tokyo, Japan

[73] Assignee: Takigen Manufacturing Co. Ltd., Tokyo, Japan

[21] Appl. No.: 193,722

[22] Filed: Feb. 9, 1994

Related U.S. Application Data

[63] Continuation of Ser. No. 61,486, May 13, 1993, abandoned.

[30] Foreign Application Priority Data

May 29, 1992 [JP] Japan ..... 4-043292[U]

[51] Int. Cl.[5] ..... E05C 3/14

[52] U.S. Cl. ..... 292/228; 292/114; 292/DIG. 46; 292/128

[58] Field of Search ..... 292/114, 121, 128, 219, 292/228, DIG. 14, DIG. 46

[56] References Cited

U.S. PATENT DOCUMENTS

| | | | |
|---|---|---|---|
| 1,046,833 | 12/1912 | Miller | 292/228 |
| 1,082,013 | 12/1913 | Denison | 292/228 |
| 1,773,751 | 8/1930 | Reidhaar | 292/228 X |
| 2,059,302 | 11/1936 | Barber et al. | 292/228 |
| 2,203,184 | 6/1940 | Srack | 292/228 X |
| 2,523,727 | 9/1950 | Sevison | 292/128 |
| 3,161,923 | 12/1964 | Crain | 292/128 |
| 3,881,758 | 5/1975 | Gross | 292/128 X |
| 4,103,945 | 8/1978 | Turman | 292/DIG. 46 |
| 4,974,887 | 12/1990 | Pucci | 292/228 |

*Primary Examiner*—Rodney M. Lindsey
*Attorney, Agent, or Firm*—Martin Smolowitz

[57] ABSTRACT

A latch assembly for a sliding door, which comprises a casing having an L-shaped latch member including a finger application arm and a latch arm, the L-shaped latch member being pivoted by a transversal pivotal pin at the intersection of the finger application and latch arms, and a striker having a circular hole, the latch arm having a free end portion formed on the back surface thereof with a latch projection capable of being engaged in and disengaged from the circular hole of the striker, the L-shaped latch being rotationally biased in the latching direction by a torsion spring, the latch projection having a front edge face formed with an inclined cam face, the latch projection having a circular sectional profile having a smaller diameter than the diameter of the circular hole of the striker. The latch projection can be reliably engaged in and disengaged from the striker hole even if there is a slight deviation from the design position of securement between the striker and casing.

5 Claims, 6 Drawing Sheets

FIG. 2
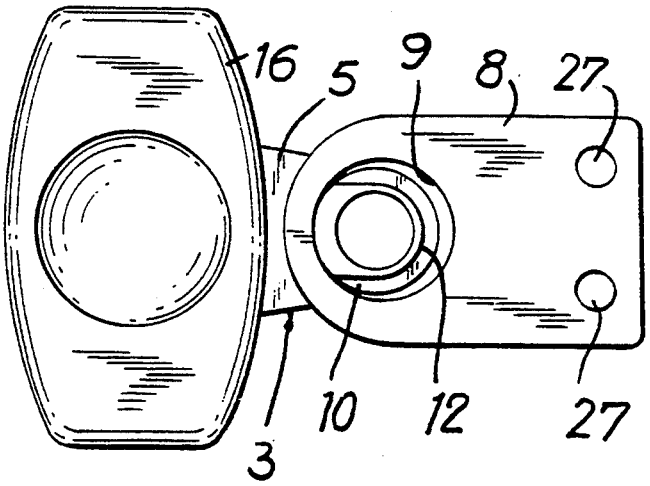
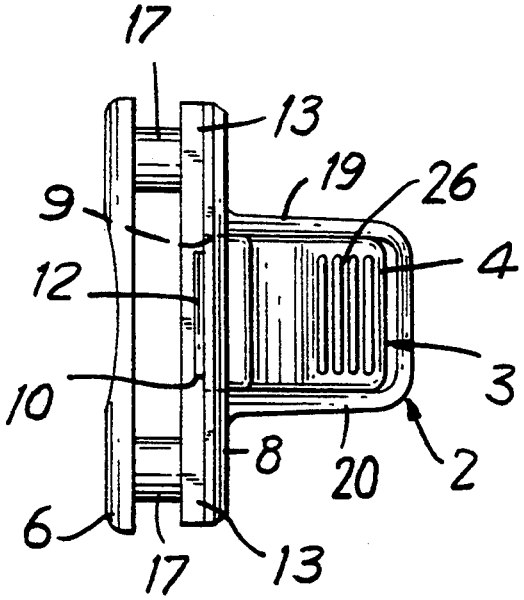
FIG. 3

FIG. 4
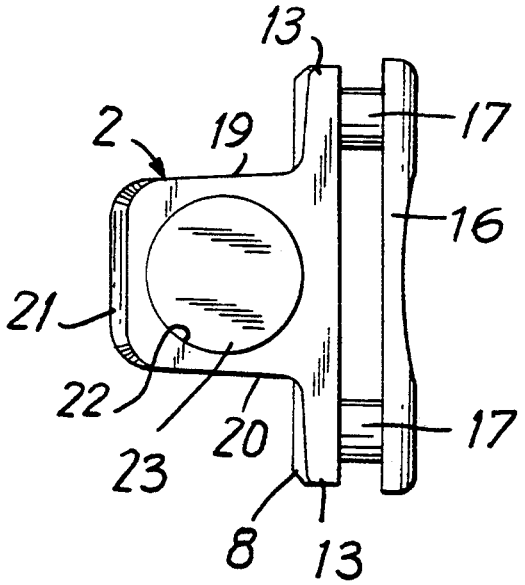
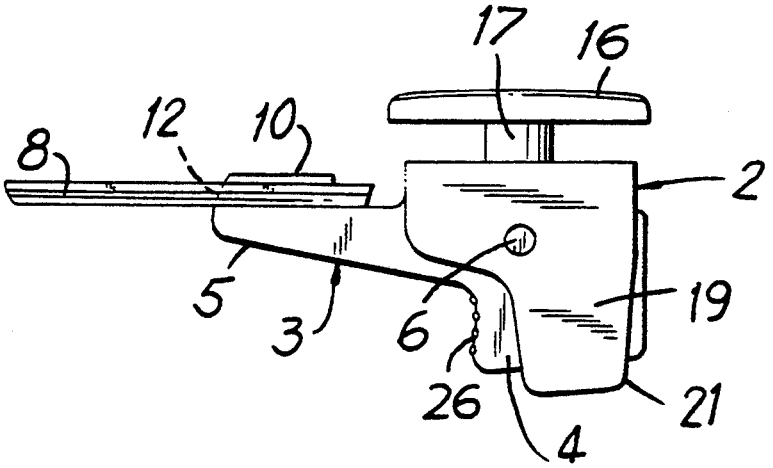
FIG. 5

FIG. 9
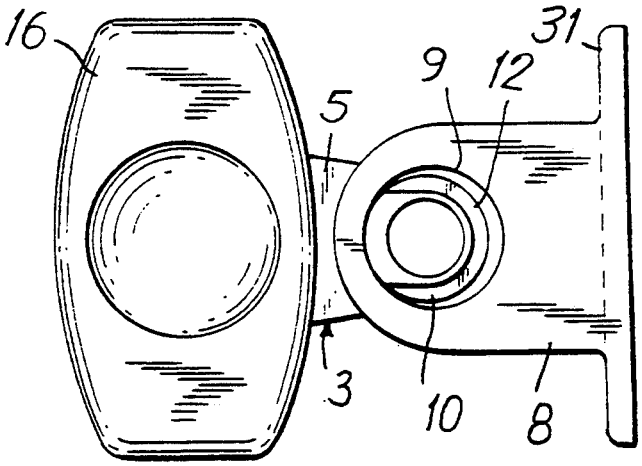
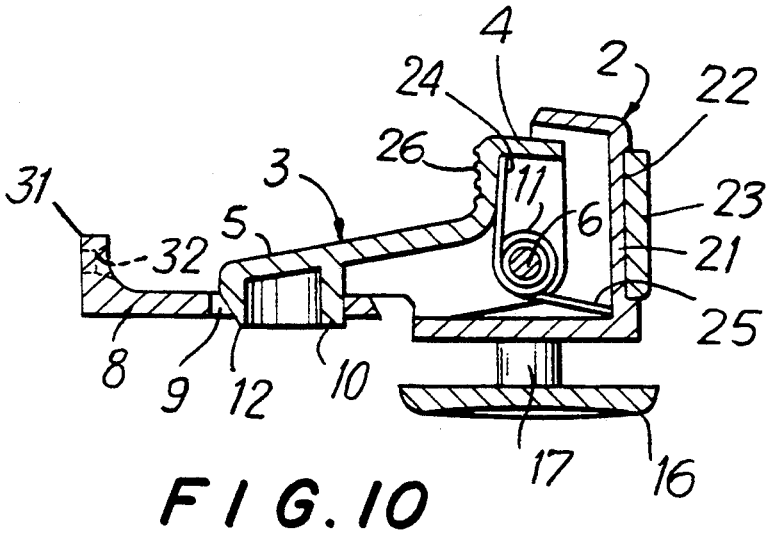
FIG. 10

LATCH ASSEMBLY FOR SLIDING DOOR

This application is a continuation, of application Ser. No. 08/061,486, filed May 13, 1993 now abandoned.

BACKGROUND OF THE INVENTION

1. Field of the Invention

This invention relates to a latch assembly used for sliding doors of electric product accommodation boxes, display cases, vehicles and so forth.

2. Prior Art

In a well-known latch assembly having a casing thereof secured to a sliding door, an L-shaped latch is pivoted by a transversal pin to the casing at an intersection between a finger application arm and a latch arm thereof. The latch arm has a free end portion provided on the back side thereof with a latch projection, which can be engaged in and disengaged from a hole formed in a striker secured to a stationary frame of a display case or the like, the L-shaped latch being rotationally biased in the latching direction by a torsion spring, and the latch projection has its front edge face formed with an inclined cam face.

In this latch assembly, immediately before the sliding door being moved in the closing direction is fully closed, the inclined cam face is brought into frictional contact with an edge surface of the striker to cause slight rotation of the L-shaped latch in the direction opposite to the direction of biasing by the torsion spring. Thus, the latch arm rides on the striker. When the sliding door is completely closed, the L-shaped latch is rotated in the latching direction by the biasing force of the torsion spring, causing its latch projection to be engaged in the hole of the striker. The engagement between the hole and latch projection is held by the spring force of the torsion spring, thus holding the sliding door in the latched position.

With this prior art latch assembly, however, the hole of the striker is a rectangular hole, and also the latch projection has a rectangular sectional profile. Therefore, if there is a departure from the design position of either or both of the striker and casing so that the striker hole and latch projection fail to be aligned accurately, the rectangular sectional profile of the latch projection fails to overlap the rectangular hole. In consequence, an edge of the sectional profile of the latch projection is caught by an edge portion of the striker around the rectangular hole thereof, thus resulting in the failure of engagement between the latch projection and striker hole.

SUMMARY OF THE INVENTION

An object of the invention, accordingly, is to provide a latch assembly for a sliding door, which can ensure reliable engagement between the striker hole and latch projection of the latch assembly even if there is a slight departure from the position of securement between the striker hole and latch member.

To attain the above object of the invention, there is provided a latch assembly for a sliding door, which comprises a casing secured to a sliding door and having an L-shaped latch member including a finger application arm and a latch arm, the L-shaped latch member being pivoted by a transversal pivotal pin to the casing at an intersection between the finger application and latch arms, and a striker secured to a stationary frame and having a circular hole, the latcharm having a free end portion provided on the back side thereof with a latch projection capable of being engaged in and disengaged from the circular hole of the striker, the L-shaped latch being rotationally biased in the latching direction by a torsion spring, the latch projection being provided on a front edge face thereof with an inclined can face for riding on the striker, the latch projection having a circular sectional profile having a smaller diameter than the diameter of the circular hole.

With this construction of the latch assembly according to the invention, the latch projection has a circular sectional profile smaller in diameter than the diameter of the circular hole of the striker, thus ensuring reliable engagement of the latch projection in the striker hole even if there is a slight departure from the design position of the securement between the striker and casing.

In addition, the operation of securing the latch assembly can be done efficiently without need of any scrupulous positioning or fine adjustment of the casing and striker.

BRIEF DESCRIPTION OF THE DRAWINGS

The above and other objects, features and advantages of the invention will become more apparent from the following description when the same is read with reference to the accompanying drawings, in which:

FIG. 2 is a back view showing the same latch assembly;

FIG. 3 is a left side view showing the same latch assembly;

FIG. 4 is a right side view showing the same latch assembly;

FIG. 5 is a plan view showing the latch assembly;

FIG. 9 is a back view showing the latch assembly shown in FIG. 8; and

FIG. 10 is a sectional view taken along line C—C in FIG. 8.

DETAILED DESCRIPTION OF THE PREFERRED EMBODIMENTS

Figure 1:
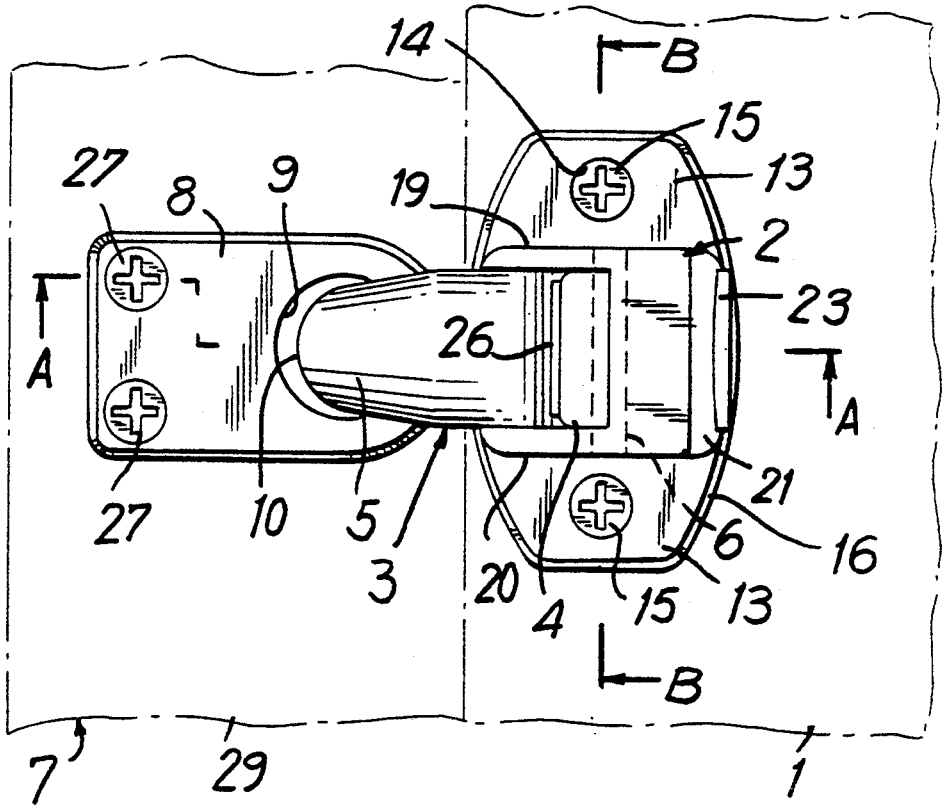
FIG. 1 is a front view showing one embodiment of the latch assembly for a sliding door according to the invention in a latched state.
Figure 6:
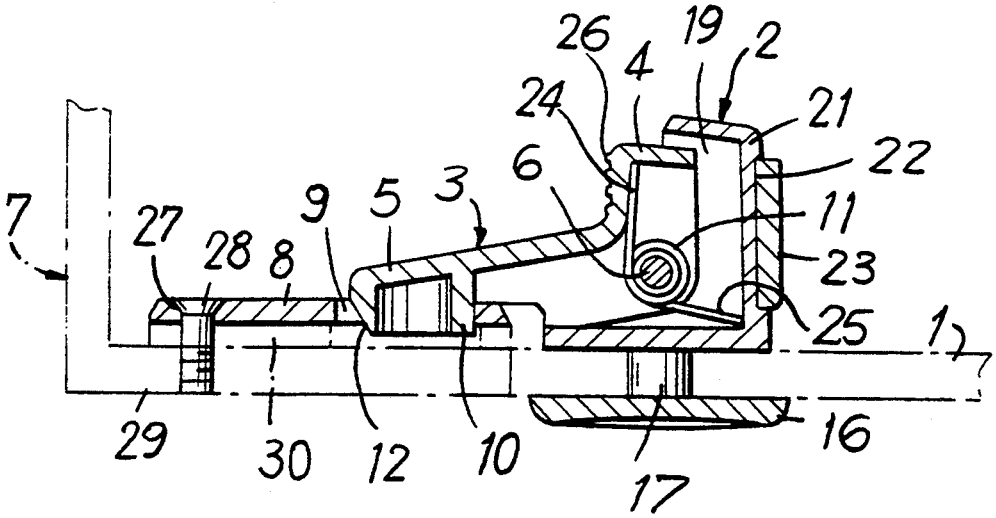
FIG. 6 is a sectional view taken along line A—A in FIG. 1.
Figure 7:
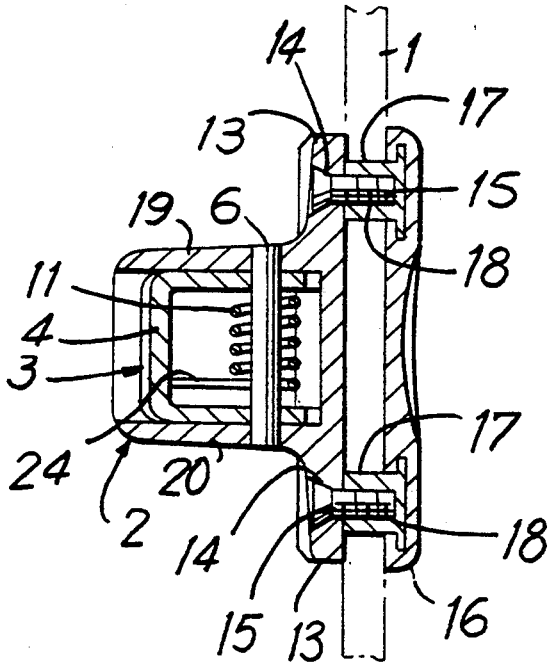
FIG. 7 is a sectional view taken along line B—B FIG. 1.

One embodiment of the invention will now be described with reference to FIGS. 1 to 7. Referring to the Figures, there is shown a latch assembly for a sliding door. The latch assembly comprises a casing 2 secured to the sliding door 1. It also has an L-shaped latch member which includes a finger application arm 4 and a latch arm 5. At the intersection of these arms 4 and 5, the L-shaped latch 3 is pivoted by a transversal pivotal pin 6 to the casing 2. A striker 8, which is secured to a stationary frame 7, has a circular hole 9. The latch arm 5 is provided on the back side of its free end with a latch projection 10, which can be engaged in and disengaged from the hole 9. The L-shaped latch 3 is rotationally biased in the latching direction by a torsion spring 11 providal around the pivoted pin 6. The latch projection 10 has its front edge face provided with an inclined cam face 12 for causing the latch arm 5 to ride on the striker 8 during engagement.

In operation, when the sliding door 1 is moved in the closing direction, the inclined can face 12 is brought into contact with the edge face of the striker 8 right before the door is fully closed. With a further movement of the door 1 in the same direction, the latch arm 5 is pushed upward by the inclined can face 12 in contact with the edge face noted above, and the L-shaped latch 3 is slightly rotated about the transversal pivotal pin 6 in the opposite direction to the direction of biasing by the torsion spring 11.

The latching movement of the sliding door 1 is continued with the latch arm 5 riding on the striker 8. When the sliding door 1 is fully closed, the L-shaped latch 3 is rotated in the latching direction by the biasing force of the torsion spring 11, and the latch projection 10 of the latch arm 5 enters the hole 9 of the striker 8. The latch projection 10 is held latched in the hole 9 by the torsion spring 11, and thus the sliding door 1 is held in the latched position.

To unlatch the sliding door 1, the finger application arm 4 of the L-shaped latch 3 is pushed. As a result, the L-shaped latch 3 is kicked up against the biasing force of the torsion spring 11 to cause the latch projection 10 of the latch arm 5 be detached from the hole 9 of the striker 8. In this state, the sliding door 1 is moved in the Opening direction. When the door 1 is moved up to a position at which the latch projection 10 will no longer be engaged in the hole 9, the latch arm 4 is released.

In this embodiment, the casing 2 is made of nylon and is disposed oil the front side of the sliding door 1, and has an upper and a lower mounting wing 13. Set screws 15 are inserted through holes 14 formed in the upper and lower wings 13 and screwed in threaded holes 18 formed in respective upper and lower securing bosses 17 of a trim board 16 made of nylon and located on the back side of the sliding door 1. The trim board 16 is formed by insert molding such that it is integral with the bosses 17.

The finger application arm 4 of the L-shaped latch 3 made of nylon, is accommodated in a space defined between paired spaced apart bearing walls 19 and 20 of the casing 2.

The bearing walls 19 and 20 are connected together by a connecting wall. 21, which has a recess 22 provided on the wall outer side. A cushioning disk 23 made of rubber is received in the recess 22 and secured to the wail 21. The torsion spring 11 is fitted on a transversal pivotal pin 6 made of stainless steel, and it has one straight end portion 24 in contact with the inner surface of the finger application arm 4 and the other straight end portion 25 in contact with the front surface of the casing 2. The finger application arm 4 has an anti-slip ridge 26. The latch projection 10 of the latch arm 5 has a short cylindrical shape.

The striker 8 made of nylon has a hole 9 adjacent; its one end and two holes, i.e. , an upper and a lower, through holes 27 adjacent its other end. The striker 8 is secured by set screws 28 passed through the through holes 27 to the back side of an edge plate portion 29 of the stationary frame 7. A spacer 30 is interposed between the edge plate portion 29 and striker 8.

Figure 8:
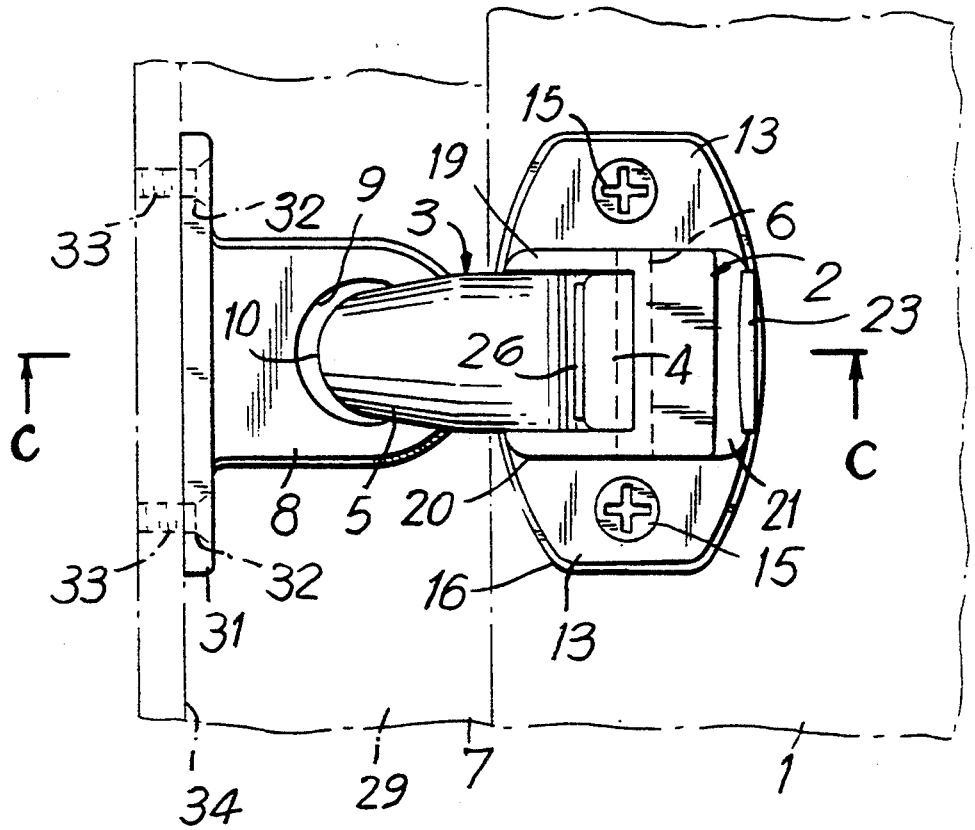
FIG. 8 is a front view showing a different embodiment of the latch assembly for a sliding door according to the invention in a latched state.

FIGS. 8 to 10 show a different embodiment of the invention. In these Figures, parts like those shown in FIGS. 1 to 7 are designated by like reference numerals. In this embodiment, striker 8 made of nylon is L-shaped and has a hole 9 formed adjacent its one end nearer the latch arm member 3 and a mounting wing 31 formed at its other or opposite end. The mounting wing 31 has two holes, i.e., an upper and a lower, through holes 32. The striker 8 is secured by screws 33 passed through the through holes 32 to the back side of an angled side plate portion 34 of stationary frame 7.

As has been described in the foregoing, with the latch assembly for a sliding door according to the invention, the latch projection 10 of the L-shaped latch 3 has a circular sectional profile having a smaller diameter than the diameter of the circular hole 9 of the striker 8. Thus, there is no stringent directivity when the latch projection 10 is engaged in the hole 9. In other words, even if the position of securement between the striker 8 and casing 2 is slightly deviated from the design position, the latch projection 10 can be smoothly engaged in the hole 9 when the sliding floor 1 is fully closed. Thus, the sliding door 1 can be reliably latched to the stationary frame 7.

Since the latch assembly, unlike Chose in the prior art, permits the engagement and disengagement between the hole 9 and latch projection 9 even if there is a slight departure from the securement position, the operation of securing the latch assembly can be done efficiently without need of any scrupulous alignment or positioning or fine adjustment.

Further, reliable engagement and disengagement may be obtained not only in the mode of use, in which the L-shaped latch 3 approaches the striker 8 in the longitudinal direction thereof, but also in a 90-degree out-of-orientation mode of use, i.e., a mode in which the L-shaped latch 3 approaches the striker 8 in the transversal direction thereof. Thus, there is no restriction imposed on the object on which the striker 8 is provided, and the latch assembly according to the invention thus can find extensive applications.

I claim:

1. A latch assembly for a sliding door, comprising a casing secured to a sliding door, said casing including a pair of spaced-apart bearing walls connected together by a connecting wall and having an L-shaped latch member including a finger application arm and a latch arm pivoted by a transversal pivotal pin to said casing between said bearing walls at an intersection between the finger application arm and the latch arm; and a striker secured to a stationary frame and having a circular hole, said latch arm having a free end portion provided on the back side thereof with a latch projection capable of being engaged in and disengaged from said circular hole of said striker, said L-shaped latch member being rotationally biased in the latching direction by a torsion spring located between said bearing walls and around the pivotal pin, said latch projection being provided on a front edge face thereof with an inclined cam face for riding on said striker, said latch projection having a circular sectional profile having a smaller diameter than the diameter of said circular hole, whereby reliable engagement between said latch member and said striker can be achieved.

2. The latch assembly according to claim 1, wherein said L-shaped latch member is arranged to approach said striker in the longitudinal direction relative to said L-shaped latch member and said striker.

3. The latch assembly according to claim 1, wherein said striker is L-shaped and has a mounting wing, and said L-shaped latch member is arranged to approach said striker in a transversal direction relative to said striker.

4. A latch assembly according to claim 1, wherein said casing includes dual mounting wings and is attached to said sliding door by utilizing a trim board located on the door back side.

5. A latch assembly according to claim 1, wherein said casing connecting wall has a recess provided on the wall outer side, said recess containing a resilient cushioning means.

* * * * *